US005528787A

United States Patent [19]

Cutler

[11] Patent Number: 5,528,787

[45] Date of Patent: Jun. 25, 1996

[54] APPARATUS FOR DRY CLEANING CARPETS

[76] Inventor: Barry L. Cutler, 7 Stanford Ct., East Windsor, N.J. 08520

[21] Appl. No.: 207,667

[22] Filed: Mar. 9, 1994

[51] Int. Cl.[6] ..... A47L 11/283

[52] U.S. Cl. ..... 15/50.1; 15/98; 15/246; 15/257.01; 220/564

[58] Field of Search ..... 15/50.1, 50.2, 15/50.3, 52, 98, 320, 246, 257.01; 220/564

[56] References Cited

U.S. PATENT DOCUMENTS

| | | | |
|---|---|---|---|
| 2,223,963 | 12/1940 | Nadig | 15/50.1 |
| 3,466,690 | 9/1969 | Cooper | 15/50.1 |
| 3,619,848 | 11/1971 | Salzmann | 15/50.1 |
| 4,295,622 | 10/1981 | Cutler | 248/313 |
| 4,418,438 | 12/1983 | Cutler | 15/230 |

FOREIGN PATENT DOCUMENTS

| | | | |
|---|---|---|---|
| 1081200 | 5/1960 | Germany | 15/50.1 |

*Primary Examiner*—Edward L. Roberts, Jr.
*Attorney, Agent, or Firm*—Donald S. Cohen

[57] ABSTRACT

A container for cleaning liquid solution for a carpet dry cleaning apparatus includes an outer wall having a cylindrical front portion and a flat back portion, an annular bottom wall at the bottom edge of the front portion of the outer wall, a top wall extending across the top edge of the outer wall, an inner wall extending around the inner edge of the bottom wall spaced inwardly from and extending along a portion of the front portion of the outer wall, and an inner bottom wall extending from the top edge of the inner wall to the back portion of the outer wall. The walls form a chamber for the cleaning liquid solution which extends across a portion of the inner bottom wall and annularly between the inner wall and the front portion of the outer wall. The container is adapted to fit over and around a motor mounted on a base of a carpet dry cleaning machine and can be secured to the base by screws extending from the bottom wall into the base.

17 Claims, 2 Drawing Sheets

APPARATUS FOR DRY CLEANING CARPETS

FIELD OF THE INVENTION

The present invention relates to an apparatus for dry cleaning carpets, rugs and the like, and, more particularly, to such an apparatus having a large tank for containing the dry cleaning solution.

BACKGROUND OF THE INVENTION

Two techniques typically used to clean floor carpets, rugs and the like are wet cleaning, such as hot water extraction or so-called "steam cleaning" and shampooing, and dry cleaning. For dry cleaning carpets, a cleaning fluid is sprayed onto the carpet and a pad is rotated over the carpet to work the cleaning solution into the carpet and thereby remove the dirt, and to absorb the dirty cleaning solution from the carpet. The dry cleaning technique has the advantage over the wet technique in that it does not soak the carpet and any underlying padding, and thereby does not damage the carpet and padding. One type of apparatus which has been used for dry cleaning carpets is shown and described in U.S. Pat. No. 4,295,622 to B. L Cutler, issued Oct. 20, 1981 and entitled "Framework Holder For Attaching Container To Floor Machine". This apparatus includes a base having a flat, circular pad holder across its bottom. A motor is mounted on top of the base and drives a shaft for rotating the brush. A handle extends from the base to permit the apparatus to be moved across a carpet. A container is mounted on the motor and contains a dry cleaning liquid solution. A motor driven pump is mounted in the container to pump the dry cleaning solution from the container to a spray nozzle on the container which sprays the carpet ahead of the apparatus. A dry cleaning pad is mounted on the bottom of the brush. The pad has portions which scrub the dry cleaning solution into the carpet to remove the dirt, and portions which soak up the dirty dry cleaning solution. One such pad is shown in U.S. Pat. No. 4,418,438 to B. L. Cutler, issued Dec. 6, 1983, entitled "Rotary Carpet Cleaning Pad".

It would be desirable to have a large container for the dry cleaning solution in order to allow longer use of the apparatus without having to refill the container with the dry cleaning solution. However, to increase the size of the container by merely making it higher or wider has certain disadvantages. Such a larger tank makes it more difficult to move the apparatus under or between pieces of furniture. Also, it raises the center of gravity of the apparatus. It is desirable that the center of gravity of the apparatus be as low as possible to have the apparatus run smoother.

SUMMARY OF THE INVENTION

One aspect of the present invention is directed to a container for a carpet dry cleaning apparatus which includes an outer wall, a top wall across the top edge of the outer wall, a semi-annular bottom wall having an outer edge at the bottom edge of the outer wall, an inner wall extending from an inner edge of the bottom wall spaced from and extending partially along the outer wall, and an inner bottom wall extending from the top edge of the inner wall to the outer wall. The walls form a cleaning liquid solution chamber which has a first portion which extends over the inner bottom wall and a second portion which extends between the inner and outer wall.

A second aspect of the present invention is directed to a carpet dry cleaning apparatus which includes a base, a motor on the base, a handle extending from the base and a container mounted on the base. The container extends over and around the motor and is adapted to contain a cleaning liquid solution.

A third aspect of the present invention is directed to a container for a carpet dry cleaning apparatus which includes a plurality of walls including an outer wall forming therein a chamber for the cleaning liquid solution. A first pipe extends from the top of the chamber through the outer wall, and a second pipe extends from the bottom of the chamber through the outer wall. A flexible, transparent tube extends between the pipes with one end of the tube being secured to the second pipe and the other end of the tube slidably fitting over the first tube.

A fourth aspect of the present invention is directed to a container for a carpet dry cleaning apparatus which includes a plurality of walls including a top wall forming therein a chamber for the cleaning liquid solution. An opening is in the top wall to the chamber. A filter is in the opening. The filter includes a pair of rings and a sheet of a porous material extending across the rings with the peripheral edge of the sheet being secured between the rings. A string extends across the porous sheet and has its ends secured to a ring.

DETAILED DESCRIPTION

Figure 1:
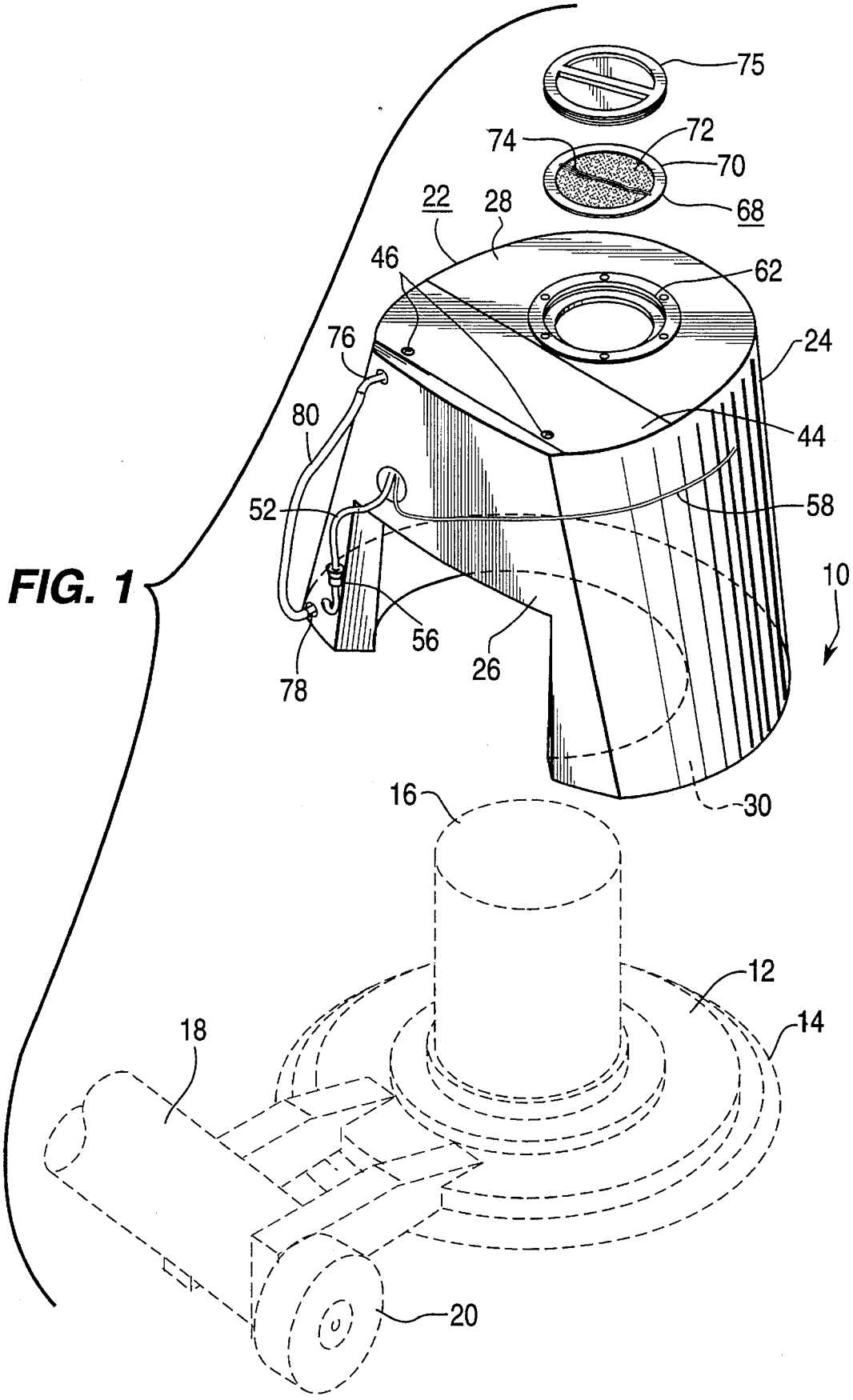
FIG. 1 is an exploded perspective view of the dry cleaning apparatus of the present invention.

Referring to the drawings, the dry cleaning apparatus of the present invention is generally designated as 10. Apparatus 10 comprises a base 12 having a flat, circular pad holder 14 extending across the bottom thereof. A motor 16 is mounted on the top of the base 12. The motor 16 has a shaft, not shown, which is connected to the pad holder 14 so as to rotate the pad holder 14. A handle 18 is connected to the base 12 to permit moving the base 12 and the brush 14 over a carpet to be cleaned. A pair of wheels 20 (only one of which is shown) are mounted on the base 12 to allow the base 12 to be moved around when it is not being used for cleaning. A container 22 of the present invention is mounted on the base 12 and around the motor 16.

The container 22 has a substantially cylindrical front outer wall portion 24 and a substantially flat back outer wall portion 26. A flat top wall 28 extends across the tops of the outer wall portions 24 and 26. A semi-annular bottom wall 30 (see FIG. 1) extends around the bottom edge of the cylindrical front outer wall portion 24 to the flat back outer wall portion 26. A substantially cylindrical inner wall 32 extends-around the inner edge of the bottom wall 30 spaced from the front outer wall portion 24 to the back outer wall portion 26. An inner bottom wall 34 (see FIG. 2) extends across the top edge of the inner wall 32 to the back wall portion 26. A vertical divider wall 36 extends across the inner bottom wall 34 to the inner surface of the front outer wall portion 24. This forms the container 22 with a cleaning liquid solution chamber 38 and a motor-pump chamber 40. The liquid solution chamber 38 extends over a portion of the inner bottom wall 34 and around the inner wall 32 between the inner wall 32 and the outer wall portion 24. The motor-pump chamber 40 extends over a portion of the inner bottom wall 34.

A portion 44 of the top wall 28 which extends over the motor-pump chamber 40 is removable and is secured in place to the container 22 by a pair of screws 46 (see FIG. 1). Within the motor-pump chamber 40 is an electric motor 48 having a high pressure pump 50 thereon. A tube 52 extends between the bottom of the liquid solution chamber 38 and the inlet port 54 of the pump 50. A filter 56 is in the tube 52 to filter out any contaminants which may be in the cleaning solution. A tube 58 extends between the outlet port 60 of the pump 50 to a spray nozzle, not shown, on the apparatus 10.

An inlet opening 62 is in the top wall 28 over the cleaning liquid solution chamber 38. The opening 62 has two ledges 64 and 66, one below the other, with the upper ledge 64 having a larger diameter than the lower ledge 66. A filter 68 is in the opening 62 and is seated on the lower ledge 66. The filter 68 comprises a pair of annular rings 70 of a relatively rigid material, such as a plastic, and a sheet 72 of a filter material extending across the rings 70 and having its peripheral edge secured between the rings 70. The filter sheet 72 is made of a relative strong, porous material, such as nylon or the like. A string 74 extends across the filter sheet 72 with its ends being secured to the rings 70. The string 74 allows for handling the filter 68 when placing it into or removing it from the opening 62. A circular cap 75 is threaded into the opening 62 and is seated on the upper ledge 64. The filter 68 serves to filter out any contaminants from the cleaning liquid solution when it is poured into the chamber 38.

Figure 2:
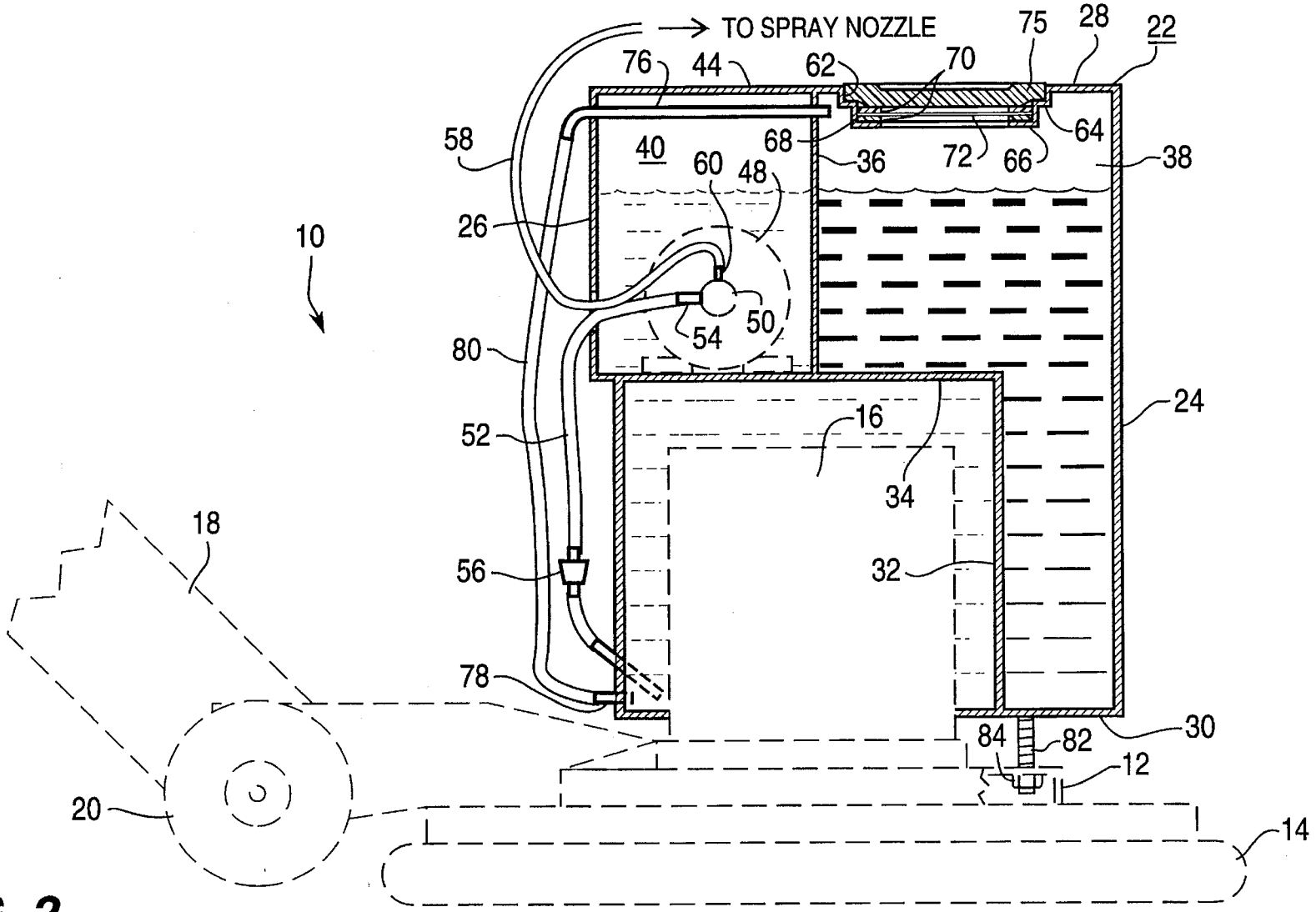
FIG. 2 is a sectional view across the container for the dry cleaning solution with the rest of the apparatus being shown in phantom.

As shown in FIG. 2, a pipe 76 extends from the upper portion of the chamber 38 across the motor pump chamber 40 and through the back outer wall 26. A pipe 78 extends from the lower portion of the chamber 38 through the back outer wall 26 vertically below the pipe 76. A flexible, transparent tube 80, such as a plastic tube, has one end slidably fitting over the pipe 76 and its other end fitting over and secured to the pipe 78. The tube 80 receives the cleaning liquid solution from the chamber 38 through the pipe 78 so as to serve as a sight glass to provide an indication of the level of the cleaning liquid solution in the chamber 38. Since the tube 80 slidably fits over the pipe 76, its upper end can be removed from the pipe 76. The tube 80 can be lowered to allow the cleaning liquid solution in the chamber 38 to flow through the tube 80 and thereby drain the chamber 38. Thus, the tube 80 serves as both a sight tube for determining the level of the cleaning liquid solution in the chamber 38 as well as a drain tube for draining the cleaning liquid solution from the chamber 38.

The container 22 fits on the base 12 over and around the motor 16 with the motor 16 being within the inner wall 32. Screws 82 are secured to and extend downwardly from the bottom wall 30. The screws 82 extend through the base 12 and have nuts 84 threaded thereon to secure the container 22 to the base 12. Although only one screw 82 is shown, there are three or more of the screws 82 spaced around the bottom wall 30 and secured to the base 12 to securely secure the container 22 to the base 12.

By having the container 22 fitting over and around the motor 16, the cleaning liquid solution chamber 38 can be made large for containing a large amount of the solution without increasing the overall size of the apparatus 10. In addition, the container 22 is positioned low on the base 12 so that the center of gravity of the apparatus 10 is maintained low. This provides for smoother operation of the apparatus 10 and deeper cleaning while increasing the size of the cleaning liquid solution chamber 38. Also, it still allows the apparatus 10 to be moved under and between pieces of furniture which may be on the carpet and which cannot be readily moved to clean the carpet. Thus, there is provided by the present invention a dry cleaning apparatus for carpet, rugs and the like having a larger container for the dry cleaning liquid solution to allow for longer operation of the apparatus without having to stop to refill the container. This is achieved without substantially increasing the overall size of the apparatus so that the apparatus can be still moved under and between pieces of furniture. Also, it is achieved while maintaining the center of gravity of the apparatus low to provide for smooth operation of the apparatus and deeper cleaning.

What is claimed is:

1. A container for a carpet dry cleaning apparatus comprising:

an outer wall having a substantially cylindrical front portion and a back portion, said back portion having a notch therein extending from a bottom edge thereof;

a top wall across the top edge of the outer wall;

a semi-annular bottom wall having an outer edge at the bottom-edge of the outer wall;

an inner wall extending along an inner edge of the bottom wall to the back wall portion of the outer wall, said inner wall being spaced radially inwardly from and extending partially along the front portion of the outer wall; and an inner bottom wall extending from the top edge of the inner wall to the back portion of the outer wall;

said walls forming a cleaning liquid solution chamber which has a first portion which extends over the inner bottom wall and a second portion which is between the inner and outer walls.

2. The container of claim 1 wherein the outer wall has a substantially flat back portion.

3. The container of claim 2 further comprising a divider wall extending from the inner bottom wall to the top wall and between portions of the front portion of the outer wall to form a motor-pump chamber over the inner bottom wall and along the back portion of the outer wall.

4. The container of claim 3 further comprising a motor-pump assembly in the motor-pump chamber, a first tube extending from the bottom of the cleaning liquid solution chamber to an inlet port of the pump, a filter in said first tube, and a second tube extending from an outlet port of the pump.

5. The container of claim 4 in which a portion of the top wall over the motor-pump chamber is removable, and means releasably securing the removable portion of the top wall to the container.

6. The container of claim 2 further including a first pipe extending from the top of the cleaning liquid solution chamber through the outer wall, a second pipe extending from the bottom of the cleaning liquid solution chamber through the outer wall and a transparent tube connected at each of its ends to a separate one of the pipes.

7. The container of claim 6 wherein the tube is flexible and is secured to the second pipe and slidably fits over the first pipe.

8. The container of claim 2 further comprising an opening in the top wall to the cleaning liquid solution chamber, a filter in said opening and a cap threaded into the opening over the filter.

9. The container of claim 8 wherein the filter comprises an annular ring and a sheet of a porous material extending across and secured to the ring.

10. The container of claim 9 wherein the filter comprises a pair of annular rings and the sheet of porous material has its peripheral edge secured between the rings.

11. The container of claim 10 in which the filter further comprises a string extending across the sheet of porous material and having its ends secured to one of the rings.

12. A dry cleaning apparatus for carpets and the like comprising:

a base;

a motor on the base;

a handle extending from the base; and a container for cleaning liquid solution on and secured to the base, said container extending over and around the motor and comprising:

an outer wall having a substantially cylindrical front portion and a back portion, said back portion having a notch therein extending from a bottom edge thereof;

a top wall across the top edge of the outer wall;

a semi-annular bottom wall having an outer edge at the bottom edge of the outer wall;

an inner wall extending along an inner edge of the bottom wall to the back portion of the outer wall and spaced radially inwardly from and extending partially along the front portion of the outer wall; and an inner bottom wall extending from the top edge of the inner wall to the back portion of the outer wall;

said walls forming a cleaning solution chamber which has a first portion which extends over the inner bottom wall and a second portion between the inner and outer walls, the inner wall extending around the motor and the inner bottom wall extending over the motor.

13. The apparatus of claim 12 wherein the outer wall of the container has a substantially flat back portion.

14. The apparatus of claim 13 in which the container further comprises a divider wall extending from the inner bottom wall to the top wall and between portions of the front portion of the outer wall to form a chamber over the bottom wall and along the back portion of the outer wall, a motor-pump assembly in said chamber, a first tube extending from the bottom of the cleaning liquid solution chamber to an inlet port of the pump, a filter in said first tube, and a second tube extending from an outlet port of the pump.

15. The apparatus of claim 14 in which a portion of the top wall of the container over the chamber containing the motor-pump assembly is removable, and means releasably securing the removable portion of the top wall to the container.

16. The apparatus of claim 13 in which the container has an opening in the top wall to the cleaning liquid solution chamber, a filter is in said opening and a cap is threaded in the opening over the filter.

17. The apparatus of claim 16 wherein the filter comprises a pair of annular rings, a sheet of a porous material extending across the rings and having its peripheral edge secured between the rings, and a string extending across the sheet of porous material and having its ends secured to one of the rings.

* * * * *